US009373487B2

(12) United States Patent
Fujita

(10) Patent No.: US 9,373,487 B2
(45) Date of Patent: Jun. 21, 2016

(54) MASS SPECTROMETER

(71) Applicant: SHIMADZU CORPORATION, Kyoto-shi, Kyoto (JP)

(72) Inventor: Shinjiro Fujita, Kameoka (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/889,605

(22) PCT Filed: May 8, 2013

(86) PCT No.: PCT/JP2013/062914
§ 371 (c)(1),
(2) Date: Nov. 6, 2015

(87) PCT Pub. No.: WO2014/181396
PCT Pub. Date: Nov. 13, 2014

(65) Prior Publication Data

US 2016/0118235 A1 Apr. 28, 2016

(51) Int. Cl.
*H01J 49/02* (2006.01)
*H01J 49/42* (2006.01)

(52) U.S. Cl.
CPC ..... *H01J 49/022* (2013.01); *H01J 49/4215* (2013.01)

(58) Field of Classification Search
USPC ..... 250/281, 282
See application file for complete search history.

(56) References Cited

U.S. PATENT DOCUMENTS 8,969,797 B2 * 3/2015 Fujita ..... H01J 49/004 250/281

FOREIGN PATENT DOCUMENTS

JP 8-007830 A 1/1996

OTHER PUBLICATIONS

International Search Report of PCT/JP2013/062914, dated Jun. 4, 2013. [PCT/ISA/210].

* cited by examiner

*Primary Examiner* — Kiet T Nguyen
(74) *Attorney, Agent, or Firm* — Sughrue Mion, PLLC

(57) ABSTRACT

In a pause time assigned for switching voltage applied to a quadrupole mass filter or other ion transport optical system so as to switch the mass-to-charge ratio of a target ion in an SIM measurement, the polarity of direct-current voltage applied to a pre-quadrupole mass filter is temporarily reversed. The voltage polarity reversal time is changed according to length of the pause time so that the ion intensity can sufficiently rise by the time the next dwell time begins. When the polarity of the voltage applied to the pre-quadrupole mass filter is reversed, the electric charges which lie on an insulating film of contaminants or other substances attached to the surface of the pre-quadrupole mass filter or on an insulating support structure are dispersed, whereby the charge-up is eliminated. Since ions are prevented from passing through, charge-up of a main quadrupole mass filter in the subsequent stage is also reduced.

10 Claims, 6 Drawing Sheets

POLARITY OF VOLTAGE NOT REVERSED

POLARITY OF VOLTAGE REVERSED (PRESENT INVENTION)

MASS SPECTROMETER

CROSS REFERENCE TO RELATED APPLICATIONS

This application is a National Stage of International Application No. PCT/JP2013/062914 filed May 8, 2013, the contents of all of which are incorporated herein by reference in their entirety.

TECHNICAL FIELD

The present invention relates to a mass spectrometer.

BACKGROUND ART

In a liquid chromatograph mass spectrometer (LCMS) in which a mass spectrometer is used as the detector for a liquid chromatograph, a mass spectrometer which employs an atmospheric pressure ion source capable of directly ionizing a liquid sample is generally used. In this type of mass spectrometer, samples are ionized under generally atmospheric pressure, while the mass spectrometry of the generated ions is performed with a mass analyzer (such as a quadrupole mass filter) placed in an analysis chamber in which a high-vacuum atmosphere is maintained. To maintain the degree of vacuum within the analysis chamber, one or more intermediate vacuum chambers with the degree of vacuum increased in a stepwise manner are provided between the ionization chamber maintained at atmospheric pressure and the analysis chamber (i.e. the configuration of a differential pumping system is adopted). The neighboring chambers are separated by a partition wall having an ion-passing hole with a small diameter, through which ions are transported.

In order to efficiently transport the ions, an ion transport optical system (which is generally called an "ion lens" or "ion guide") for focusing the ions, and for accelerating or decelerating ions in some cases, by the effect of an electric field is provided in each intermediate vacuum chamber. A sampling cone, skimmer or similar tapered device provided on the partition wall separating the chambers, with the aforementioned ion-passing hole formed at its apex, can also be regarded as one kind of ion transport optical system, since those devices also have the effect of focusing, accelerating or decelerating ions by the electric field created by an appropriate amount of voltage applied to them. Similarly, the quadrupole mass filter placed in the analysis chamber, and a prefilter provided before the mass filter can also be regarded as one kind of ion transport optical system. Thus, mass spectrometers are provided with a plurality of ion transport optical systems which influence the flight path of the ions by the effects of electric fields.

In an atmospheric pressure ionization mass spectrometer, a certain amount of unwanted particles (such as the neutral particles originating from the solvent or similar substances, or the fine droplets from which the solvent is incompletely vaporized) are inevitably introduced into the intermediate vacuum chambers or analysis chamber in addition to the ions to be analyzed. Such unwanted particles often attach to the previously mentioned ion transport optical systems and accumulate on their surface. If an insulating film is formed by contaminants or foreign substances attached on the surface of an ion transport optical system, the ions impinging on that portion are likely to cause electrification, or the "charge-up" (for example, see Patent Literature 1). The charge-up can also occur due to the ions which come in contact with a structure made of a ceramic, synthetic resin or similar insulating material which are provided to hold a quadrupole mass filter, ion guide or similar system at a fixed position within a space. Allowing too much of a charge-up leads to a disturbance of the electric field formed in the ion-passing space by the voltage applied to the ion transport optical system, which impedes the passage of the ions or prevents the correct focusing or acceleration of the ions, with the consequent decrease in the amount of ions reaching the detector. That is to say, the ion intensity may possibly decrease as the measurement continues.

FIG. 4A is a chromatogram showing the intensity of the ions detected from a standard sample by an LCMS employing a quadrupole mass spectrometer into which the standard sample was repeatedly introduced at predetermined intervals of time. Each peak in the figure is the ion peak originating from the standard sample. Normally, the peak should always occur with the same intensity. However, the obtained result shows that the peak intensity gradually decreases with time, or with the repetition of the measurement. According to an experiment conducted by the present inventor, this decrease in the ion intensity is most likely due to the charge-up of the quadrupole mass filter.

CITATION LIST

Patent Literature

Patent Literature 1: JP 08-7830 A

SUMMARY OF INVENTION

Technical Problem

The present invention has been developed to solve the previously described problem. Its objective is to provide a mass spectrometer in which the charge-up of an ion transport optical system is prevented or reduced so as to prevent or reduce the temporal decrease in the ion intensity and thereby enable a high-sensitivity analysis.

Solution to Problem

The experimental result in FIG. 4A demonstrates that the decrease in the ion intensity occurs even within a comparatively short period of time in the measurement process. Accordingly, to prevent or reduce such a decrease in the ion intensity, a measure for eliminating the charge-up or reducing the degree of the charge-up needs to be performed as frequently as possible during the measurement process.

As described earlier, in a mass spectrometer, an appropriate amount of radio-frequency voltage and/or direct-current voltage for focusing the ions, and for accelerating or decelerating the ions in some cases, is applied to each ion transport optical system. Normally, the voltage is set at an optimal or nearly optimal level for the mass-to-charge ratio or mass-to-charge-ratio range for the ion being analyzed at that point in time. For example, in a selected ion monitoring (SIM) measurement performed with a quadrupole mass spectrometer, or in a multiple reaction monitoring (MRM) performed with a tandem quadrupole mass spectrometer, the operation of sequentially detecting each of the ions having specific mass-to-charge ratios is cyclically performed, in which process the voltage applied to the ion transport optical system is also sequentially switched. However, the switching of the voltage cannot be instantaneously completed; a certain amount of time is required for the voltage to stabilize after the switching. Therefore, normally, before each time slot in which detection data (e.g. ion intensities) are acquired ("dwell time"), a time slot in which the acquisition of the detection data is forbidden ("pause time") is provided, and this pause time is given a length equal to or longer than the period of time required for the stabilization of the voltage. Having noticed the fact that no data is collected during the pause time, and the fact that the pause time is regularly repeated at short intervals of time, the present inventor has conceived the idea of using this pause time to perform an operation for eliminating or reducing the charge-up. Thus, the present invention has been created.

Thus, the first aspect of the present invention developed for solving the previously described problem is a mass spectrometer having one or more ion transport optical systems for transporting ions by the effect of an electric field between an ion source and an ion detector, the mass spectrometer being capable of performing an SIM or MRM measurement in which the operation of sequentially performing a mass spectrometry on each of a plurality of ions having previously specified mass-to-charge ratios is cyclically performed, and the mass spectrometer including:

a) a voltage generator for applying a direct-current voltage corresponding to the mass-to-charge of the ion to be monitored, to at least one of the ion transport optical systems in the SIM or MRM measurement; and b) a controller for controlling the voltage generator so that, in a pause time during which the collection of detection data by the ion detector is suspended in conjunction with the switching of the mass-to-charge ratio of the ion to be monitored, if the polarity of the ion to be monitored in an SIM or MRM measurement is unchanged before and after the switching of the mass-to-charge ratio, then the direct-current voltage applied to the at least one ion transport optical system, while being switched from one specific level to another specific level in the pause time, is temporarily changed to either a level at which the direct-current voltage has a polarity different from the polarity of the direct-current voltage at those specific levels, or a level at which the direct-current voltage has the same polarity as the direct-current voltage at those specific levels yet has a smaller absolute value than the direct-current voltage at any of those specific levels.

The "ion transport optical system" in the present invention includes any element which can focus, disperse, accelerate or decelerate ions by the effect of a direct-current electric field, a radio-frequency electric field or an electric field produced by superposing those fields. Specific examples of the ion transport optical system include: devices which are commonly called the "ion lens" or "ion guides"; a device having an ion-passing hole, such as a skimmer, sampling cone, or aperture electrode; as well as a quadrupole mass filter and a pre-quadrupole mass filter disposed before the quadrupole mass filter.

In the mass spectrometer according to the first aspect of the present invention, the controller may preferably be configured to control the voltage generator so that the direct-current voltage applied to the at least one ion transport optical system, while being switched in the pause time, is temporarily changed to a level at which the direct-current voltage has a polarity different from the polarity of the direct-current voltage applied before and after the switching of the direct-current voltage.

In this configuration, under the command of the controller, when the polarity of the direct-current voltage applied from the voltage generator to the ion transport optical system in the pause time is temporarily reversed, the polarity of the voltage becomes the same as that of the charges which are accumulated on an unwanted insulating film covering the surface of the ion transport optical system, on the insulating support structure holding the ion transport optical system, or on some other areas. Therefore, the charges accumulated on the surface or existing near the surface are dispersed by the electrostatic repulsive force. Thus, the charge-up is eliminated. In SIM or MRM measurements, the pause time is repeated at comparatively short intervals of time, and the charge-up is eliminated in every pause time. Therefore, the decrease in the ion intensity due to the charge-up hardly occurs in the measurement process.

The temporary reversal of the polarity of the direct-current voltage applied to the ion transport optical system in the pause time also produces the effect of impeding the passage of the ions through the ion transport optical system (actually, their passage is almost completely prevented). Therefore, the ions can barely reach the area behind the ion transport optical system, so that the charge-up of the components provided in that area (e.g. another ion transport optical system or an insulating support structure holding it) is reduced.

Instead of reversing the polarity of the direct-current voltage applied from the voltage generator to the ion transport optical system in the pause time, a direct-current voltage whose polarity is the same as the polarity of the two levels of direct-current voltage respectively applied before and after the pause time and whose absolute value is smaller than the absolute value of any of the two levels of direct-current voltage may be temporarily applied. In this case, although the previously described charge-dispersing effect by the electrostatic repulsive force cannot be obtained, the passage of the ions through the ion transport optical system is impeded, so that the charge-up of the components located behind (such as an ion transport optical system or an insulating support structure holding it) is reduced.

For reliable elimination of the charge-up, it is preferable to maintain the reversed polarity of the direct-current voltage for the longest possible period of time. However, after the pause time is over, by the time when the next dwell time begins, the system needs to restore the state where a sufficient amount of ions can pass through the ion transport optical system and a sufficiently high level of ion intensity is obtained with the ion detector. Accordingly, in the mass spectrometer according to the first aspect of the present invention, the controller may preferably be configured so as to vary the period of time assigned for temporarily applying the direct-current voltage with the different polarity, according to the length of the pause time.

In this configuration, when the pause time is short, the period of time to reverse the polarity of the voltage can be decreased so as to minimize the decrease of the sensitivity due to the delayed rising of the ion intensity, while eliminating the charge-up. When the pause time is long, the period of time to reverse the polarity of the voltage can be increased so as to fully produce the effect of eliminating the charge-up.

The second aspect of the present invention developed for solving the previously described problem is a mass spectrometer having one or more ion transport optical systems for transporting ions by the effect of an electric field between an ion source and an ion detector, the mass spectrometer being capable of performing an SIM or MRM measurement in which the operation of sequentially performing a mass spectrometry on each of a plurality of ions having previously specified mass-to-charge ratios is cyclically performed, and the mass spectrometer including:

a) a voltage generator for applying a radio-frequency voltage having an amplitude corresponding to the mass-to-charge ratio of the ion to be monitored, to at least one of the ion transport optical systems in the SIM or MRM measurement; and b) a controller for controlling the voltage generator so as to temporarily change the amplitude of the radio-frequency voltage applied to the at least one ion transport optical system, to an amplitude at which the ion-focusing effect of the radio-frequency voltage disappears, while switching the amplitude of the radio-frequency voltage in a pause time during which the collection of detection data by the ion detector is suspended in conjunction with the switching of the mass-to-charge ratio of the ion to be monitored in an SIM or MRM measurement.

In a typical and preferable mode of the mass spectrometer according to the second aspect of the present invention, the radio-frequency voltage applied to the at least one ion transport optical system is temporarily stopped (i.e. the amplitude is set to zero) in the pause time.

In this configuration, under the command of the controller, when the radio-frequency voltage applied from the voltage generator to an ion transport optical system is temporarily stopped in the pause time, the ion-focusing effect in the ion transport optical system disappears, and the passage of the ions through that ion transport optical system is impeded (actually, their passage is almost completely prevented). Therefore, the ions can barely reach the area behind that ion transport optical system, so that the charge-up of the components provided in that area (e.g. another ion transport optical system or an insulating support structure holding it) is reduced. Another favorable effect is obtained, for example, when there is a direct-current potential difference between one ion transport optical system and the next ion transport optical system: In this situation, when the radio-frequency voltage is applied to the ion transport optical system on the front side, the thereby generated electric field tends to cause the ions to accumulate near the area where the potential difference is present, allowing those ions to easily come in contact with the ion transport optical system or its support structure on the rear side and cause charge-up. When the application of the radio-frequency voltage to the ion transport optical system on the front side is temporarily stopped and the ion-focusing effect is thereby eliminated, the ions accumulated in the area where the direct-current potential difference is present become easier to be dispersed, so that the charge-up of the ion transport optical system and its support structure on the rear side is reduced.

Similarly to the mass spectrometer according to the first aspect, the mass spectrometer according to the second aspect may preferably be configured so that the period of time assigned for temporarily changing the radio-frequency voltage to the amplitude at which the ion-focusing effect disappears is varied according to the length of the pause time. According to this configuration, when the pause time is short, the period of time to temporarily switch to the amplitude at which the ion-focusing effect disappears can be decreased so as to minimize the decrease of the sensitivity due to the delayed rising of the ion intensity, while eliminating the charge-up. When the pause time is long, the period of time to temporarily switch to the amplitude at which the ion-focusing effect disappears can be increased so as to fully produce the effect of eliminating the charge-up.

Advantageous Effects of the Invention

In the mass spectrometer according to the present invention, the charge-up of an ion transport optical system, a support structure holding the ion transport optical system and similar other components is eliminated or reduced during an SIM or MRM measurement.

Since the decrease in the amount of passing ions due to the charge-up is thereby avoided, the temporal decrease in the detection sensitivity or accuracy does not occur, so that the analysis can be performed with high sensitivity and high accuracy.

DESCRIPTION OF EMBODIMENTS

A quadrupole mass spectrometer as one embodiment of the present invention is hereinafter described with reference to the attached drawings.

Figure 1:
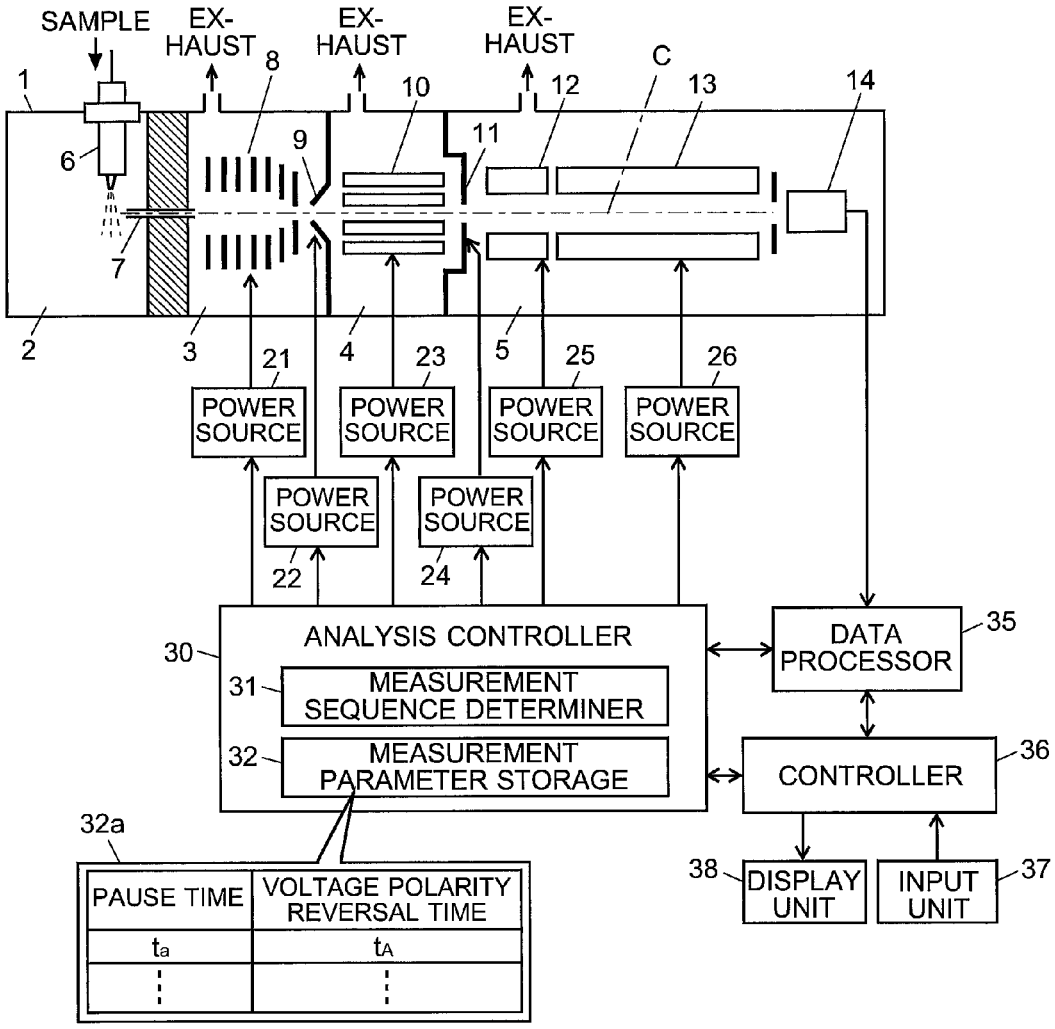
FIG. 1 is a schematic configuration diagram showing the main components of a quadrupole mass spectrometer according to one embodiment of the present invention.

FIG. 1 is a configuration diagram showing the main components of the quadrupole mass spectrometer of the present embodiment.

The quadrupole mass spectrometer of the present embodiment has a casing 1, which contains an ionization chamber 2 for ionizing the compounds in a sample under generally atmospheric pressure and an analysis chamber 5 in which a high vacuum atmosphere is maintained for performing a mass spectrometry of ions and detecting those ions. Additionally, a first intermediate vacuum chamber 3 and a second intermediate vacuum chamber 4, with a stepwise increase in the degree of vacuum, are provided between the ionization chamber 2 and the analysis chamber 5. The ionization chamber 2 contains an electrospray ionization (ESI) probe 6 for ionizing the compounds in a liquid sample by electrostatic atomization of the sample. Each of the first and second intermediate vacuum chambers 3 and 4 contains an ion lens 8 and a multipole ion guide 10 for transporting ions while focusing them by the effect of a radio-frequency electric field. The analysis chamber 5 contains a pre-quadrupole mass filter 12, a main quadrupole mass filter 13 and an ion detector 14 arranged along the ion beam axis C.

In the system of the present embodiment, the ion lens 8 consists of a plurality of (e.g. four) virtual rod electrodes arranged around the ion beam axis C, with each virtual rod electrode consisting of a plurality of electrode elements arrayed at predetermined intervals along the ion beam axis C. The multipole ion guide 10 is composed of a plurality of (e.g. eight) rod electrodes arranged around the ion beam axis C and extending parallel to the ion beam axis C. As for the pre-quadrupole mass filter 12 and the main quadrupole mass filter 13, each of them is composed of four rod electrodes arranged around the ion beam axis C and extending parallel to the ion beam axis C, with the rod electrodes of the former mass filter being shorter than those of the latter.

The ionization chamber 2 and the first intermediate vacuum chamber 3 communicate with each other through a heated capillary 7 which is heated to an appropriate temperature. The first intermediate vacuum chamber 3 and the second intermediate vacuum chamber 4 communicate with each other through a small ion-passing hole formed at the apex of a skimmer 9. The second intermediate vacuum chamber 4 and the analysis chamber 5 communicate with each other through a small ion-passing hole formed in an aperture electrode 11.

The ion lens 8, skimmer 9, multipole ion guide 10, aperture electrode 11, pre-quadrupole mass filter 12 and main quadrupole mass filter 13 arranged along the ion beam axis C are supplied with either a direct-current voltage or a composite voltage of radio-frequency voltage and direct-current voltage from the power sources 21-26, respectively. Each of these devices is used for focusing or dispersing ions, or for accelerating or decelerating ions, by the effect of an electric field (a radio-frequency or direct-current electric field). That is to say, those devices are used for transporting ions while controlling their motion. Therefore, any of them can be regarded as an ion-transport optical system in a broad sense. Though not shown in FIG. 1, the heated capillary 7 and other components are also supplied with an appropriate amount of voltage.

The operations of the power sources 21-26 are controlled by an analysis controller 30. The analysis controller 30 has a measurement sequence determiner 31 and a measurement parameter storage section 32 as the functional blocks in charge of the operations which are characteristic of the system of the present embodiment. A data processor 35 receives detection signals obtained with the ion detector 14 and performs various kinds of processing, such as the creation of a mass spectrum, mass chromatogram, total ion chromatogram or other forms of information, a qualitative determination of an unknown compound, or a quantitative determination of a target compound. A controller 36 is responsible for controlling the system at higher levels than the analysis controller 30 as well as providing a user interface through an input unit 37 and a display unit 38. In general, at least some of the controller 36, data processor 35 and analysis controller 30 can be configured on a personal computer provided as the hardware resource, with their respective functions realized by executing a dedicated controlling and processing software program previously installed on that computer.

A normal operation of the mass spectrometry by the quadrupole mass spectrometer of the present embodiment is hereinafter outlined:

For example, when a sample liquid exiting from the column of a liquid chromatograph (not shown) is introduced into the electrospray ionization probe 6, the sample liquid is given electric charges at the tip of the probe 6 and sprayed into the ionization chamber 6 in the form of fine droplets. Due to the contact with the surrounding air, the charged droplets are broken into smaller sizes, and simultaneously, the solvent in the droplets is vaporized. During this process, the sample components in the droplets are given electric charges and turn into ions. Due to the pressure difference between the two ends of the heated capillary 7, an air stream which flows from the ionization chamber 2 into the first intermediate vacuum chamber 3 is formed. Therefore, the generated ions are drawn into the heated capillary 7 and sent into the first intermediate vacuum chamber 3. Ions derived from the sample are focused by the ion lens 8 and sent into the second intermediate vacuum chamber 4 through the ion-passing hole at the apex of the skimmer 9. Then, the ions are focused by the ion guide 10 and sent into the analysis chamber 5 through the ion-passing hole formed in the aperture electrode 11.

In the analysis chamber 5, the ions derived from the sample are introduced through the pre-quadrupole mass filter 12 into the main quadrupole mass filter 13. Since an amount of voltage which consists of a radio-frequency voltage superposed on a direct-current voltage is applied from the power source 26 to the rod electrodes of the main quadrupole mass filter 13, only an ion having a specific mass-to-charge ratio corresponding to that voltage is allowed to pass through the main quadrupole mass filter 13 and reach the ion detector 14. The ion detector 14 generates an ion-intensity signal corresponding to the amount of ions it has received. The data processor 35 processes the detection data obtained by digitizing the ion-intensity signal.

Similarly to commonly used devices of this type, the quadrupole mass spectrometer of the present embodiment is capable of selectively performing a scan measurement, SIM measurement or other kinds of measurements according to the information entered and set by a user (operator). In the case of the SIM measurement, the user sets the mass-to-charge ratios to be simultaneously monitored, the dwell time for acquiring detection data for one ion, and the pause time for switching the voltage applied to the main quadrupole mass filter 13 and other components so as to switch the mass-to-charge ratio to be monitored. However, for example, in the case where a cycle time which indicates the repetition period of the SIM measurement for one set of mass-to-charge ratios (i.e. channels) selected as the measurement target is set by the user, the dwell time and the pause time may be automatically calculated from the cycle time and the number of channels. In short, the dwell time and the pause time do not always need to be manually entered by users; in some cases, they can be automatically calculated from other measurement parameters.

Figure 2:
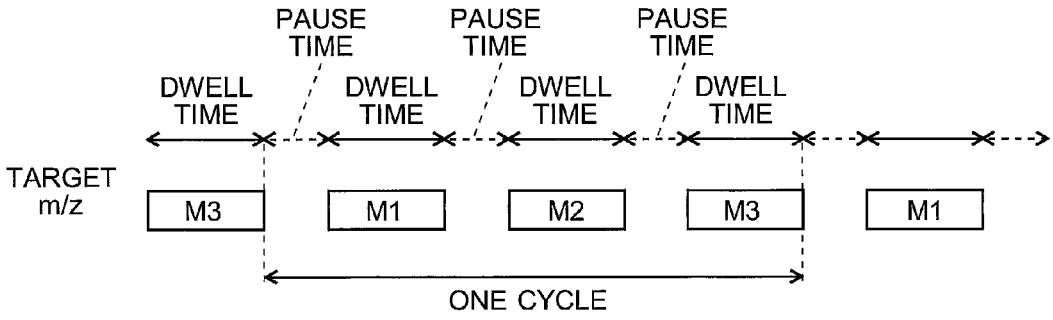
FIG. 2 is a model diagram showing the measurement sequence (the temporal change of the voltage applied to a pre-quadrupole mass filter) in an SIM measurement.

FIG. 2 is a model diagram showing one example of the temporal change of the voltage applied to the pre-quadrupole mass filter, which is specified as the measurement sequence for an SIM measurement. In the present example, three mass-to-charge ratios M1, M2 and M3 are selected as the measurement target (i.e. the number of channels is three). As shown in FIG. 2, detection data showing the intensity of an ion having a mass-to-charge ratio of M1, M2 or M3 are collected during each dwell time. The voltage-switching operation for changing the target mass-to-charge ratio (e.g. from M1 to M2, or from M2 to M3) is performed in the pause time between the two dwell times. Normally, when a command for switching the voltage is issued from the analysis controller 30, a certain amount of time is required for the voltage applied to the rod electrodes of the main quadrupole mass filter 13 to be actually switched to and stabilized at the indicated voltage. Accordingly, the pause time is determined with a certain amount of latitude to allow for the stabilization of the voltage.

As noted earlier, if the ions collide with a portion of the ion transport optical system on which an insulating film made of a contaminant or foreign substance has been formed, or with the insulating structure for holding the ion transport optical system, a charge-up occurs due to the electric charges of those ions, which impedes the efficient transport of the ions. Accordingly, in the system of the present embodiment, when an SIM measurement is performed, a characteristic control is performed in order to prevent or reduce the charge-up. This control is hereinafter described in detail.

Figure 3:
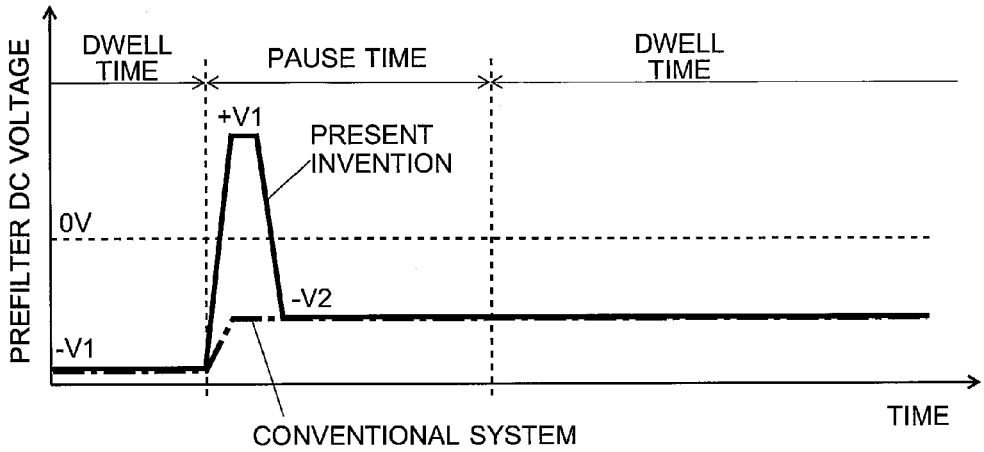
FIG. 3 is a timing chart illustrating the difference in the voltage applied in the pause time between the system of the present embodiment and a conventional system.

FIG. 3 is a timing chart illustrating the difference in the voltage applied in the pause time between the system of the present embodiment and a conventional system. This chart shows a change of the direct-current voltage (direct-current bias voltage) which is applied to the pre-quadrupole mass filter 12 in the case where the ions to be monitored are positive ions.

The optimal direct-current voltage for the monitoring of the ion at one channel is −V1, while the optimal direct-current voltage for the monitoring of the ion at the next channel is −V2. In the case of the conventional system, after the dwell time for the previous channel is completed, the direct-current voltage applied to the pre-quadrupole mass filter 12 is directly switched from −V1 to −V2 within the pause time before the next dwell time begins. By contrast, in the case of the system of the present embodiment, after the dwell time for the previous channel is completed, the direct-current voltage applied to the pre-quadrupole mass filter 12 is initially changed from −V1 to +V1 by reversing the polarity of the voltage without changing its absolute value and subsequently switched to −V2 within the pause time before the next dwell time begins.

When the polarity of the direct-current voltage applied to the pre-quadrupole mass filter 12 is temporarily reversed in this manner within the pause time, the voltage polarity becomes the same as that of the charges accumulated on (or existing near) the surface of the rod electrodes of the pre-quadrupole mass filter 12 (to be exact, on the insulating film formed on the surface) or the surface of the insulating structure holding the pre-quadrupole mass filter 12, so that the accumulated charges are dispersed and the charge-up is thereby eliminated. Furthermore, when the polarity of the direct-current voltage applied to the pre-quadrupole mass filter 12 is temporarily reversed, the passage of the ions through the pre-quadrupole mass filter 12 is almost completely prevented due to the effect of the thereby created electric field. Consequently, the amount of ions reaching the main quadrupole mass filter 13 is considerably reduced (actually, the amount becomes approximately zero), so that the charge-up on the surface of the rod electrodes of the main quadrupole mass filter 13 or the surface of the insulating structure holding the main quadrupole mass filter 13 is reduced.

Figure 4A:
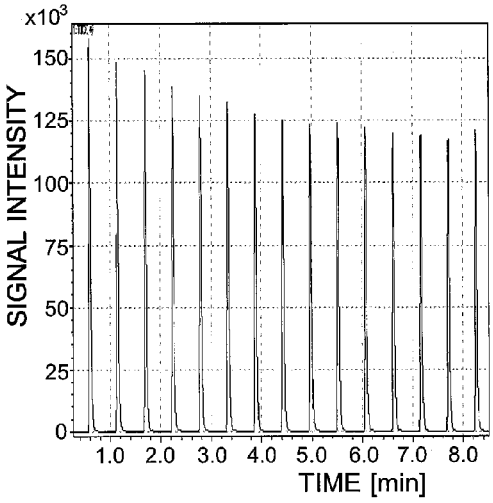
FIGS. 4A and 4B are chromatograms showing measured results of a change of the ion intensity with respect to time in the conventional system (with no reversal of the polarity of the direct-current voltage) and in the system of the present embodiment (with the reversal of the polarity of the direct-current voltage).
Figure 4B:
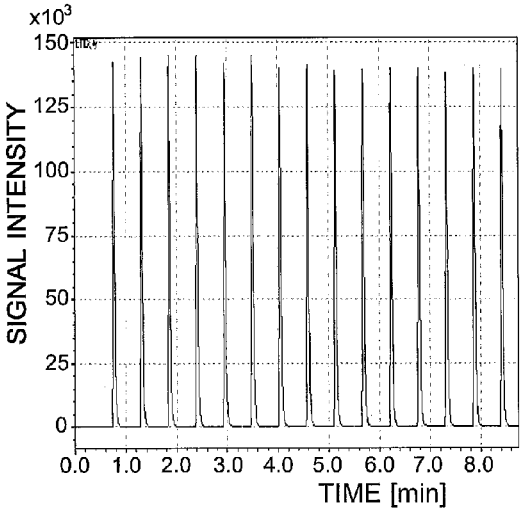

As noted earlier, FIG. 4A is a chromatogram showing a measured result of a change of the ion intensity with respect to time in the conventional system (with no reversal of the polarity of the direct-current voltage), while FIG. 4B is a chromatogram showing a measured result of a change of the ion intensity with respect to time in the system of the present embodiment in which the polarity of the direct-current voltage was reversed in the pause time as shown in FIG. 3. When the polarity of the direct-current voltage was not reversed in the pause time, the ion intensity clearly decreased with the repetition of the measurement, while such a decrease in the ion intensity barely occurred when the polarity of the direct-current voltage was reversed in the pause time. This is most likely due to the fact that the charge-up on or near the pre-quadrupole mass filter 12 and the main quadrupole mass filter 13 is eliminated by the reversal of the polarity of the direct-current voltage applied to the pre-quadrupole mass filter 12.

Figure 5:
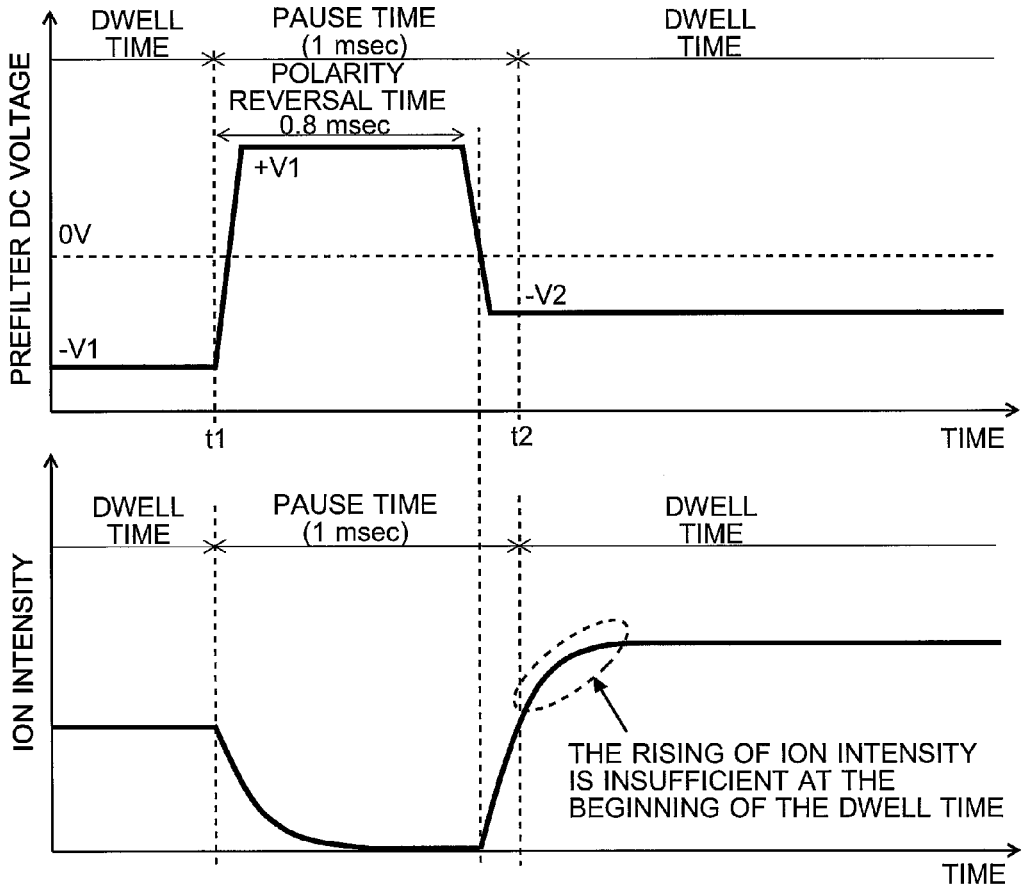
FIG. 5 shows a change of the applied voltage and a change of the ion intensity in the case where the pause time is set at 1 ms and the direct-current voltage polarity reversal time at 0.8 ms.
Figure 6:
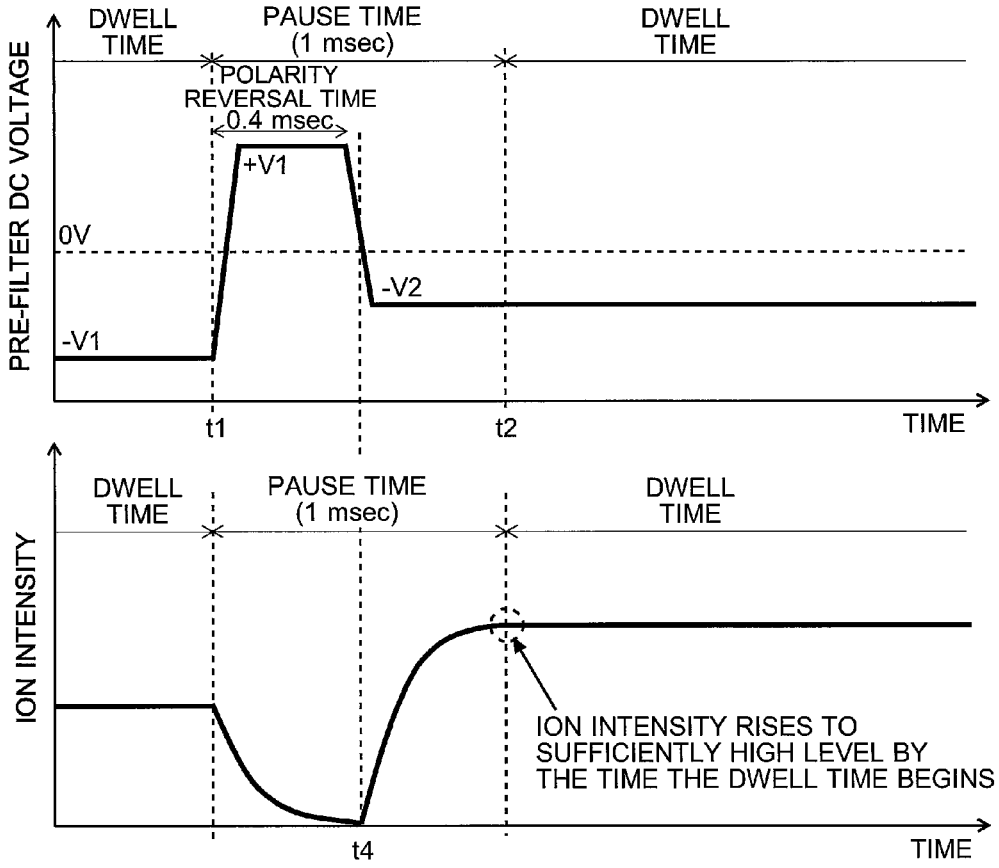
FIG. 6 shows a change of the applied voltage and a change of the ion intensity in the case where the pause time is set at 1 ms and the direct-current voltage polarity reversal time at 0.4 ms.

To improve the charge-up elimination effect, it is preferable to increase the period of time in which the polarity of the direct-current voltage is reversed (this period is hereinafter called the "voltage polarity reversal time"). However, the pause time is originally the period of time assigned for switching the voltage according to the switching of the mass-to-charge ratio; if the voltage polarity reversal time is too long, the target ions may be prevented from sufficiently passing through the pre-quadrupole mass filter 12 and the main quadrupole mass filter 13 even after the next dwell time begins, due to insufficient stabilization of the switched voltage within the pause time or other reasons. FIG. 5 shows a change of the applied voltage and a change of the ion intensity in the case where the pause time is set at 1 ms and the voltage polarity reversal time at 0.8 ms. FIG. 6 shows a change of the applied voltage and a change of the ion intensity in the case where the pause time is set at 1 ms while the voltage polarity reversal time is set at 0.4 ms, i.e. one half of the length as in the case of FIG. 5.

As shown in FIG. 5, while the polarity of the voltage applied to the pre-quadrupole mass filter 12 is reversed, ions cannot pass through the pre-quadrupole mass filter 12, so that the ion intensity temporarily becomes approximately zero. After the polarity of the applied voltage is returned, the ion intensity begins to increase. In the example of FIG. 5, the length of time from the end of the voltage polarity reversal time to the beginning of the next dwell time is too short for the ion intensity to sufficiently rise by the time when the dwell time begins. In this case, since the detection data corresponding to the ion intensities which have not reached sufficient levels are acquired as effective data by the data processor 35, the accuracy and sensitivity of the ion intensities become low. By contrast, in the example of FIG. 6, the voltage polarity reversal time is short and the length of time from the end of the voltage polarity reversal time to the beginning of the dwell time is sufficiently secured, so that the ion intensity sufficiently rises by the time when the dwell time begins. In this case, the decrease in the accuracy and sensitivity of the ion intensity due to the reversal of the voltage polarity does not occur.

Therefore, in order to eliminate the charge-up as effectively as possible without causing a decrease in the accuracy and sensitivity of the ion detection, it is preferable to optimize the voltage polarity reversal time according to the length of the pause time. For this purpose, in the quadrupole mass spectrometer of the present embodiment, the measurement parameter storage section 32 holds a table 32*a* in which the optimal value of the voltage polarity reversal time is stored for each of the selectable pause times. For example, the optimal values of the voltage polarity reversal time for the respective pause times can be experimentally determined and stored in the measurement parameter storage section 32 by the manufacturer of the present system before its shipment.

After the pause time is determined by user inputs or other operations in the previously described manner for an SIM measurement, the measurement sequence determiner 31 refers to the table 32*a* stored in the measurement parameter storage section 32 and determines the optimal voltage polarity reversal time for the set pause time. For example, when the pause time is 1 ms, the voltage polarity reversal time may be determined to be 0.4 ms. Subsequently, the measurement sequence determiner 31 finds the voltages corresponding to the mass-to-charge ratios to be monitored in the SIM measurement (e.g. −V1, −V2 and so on in the examples of FIGS. 3 and 6), and determines the measurement sequence which shows the temporal change of the voltage within one cycle, based on the dwell time, pause time, cycle time and other information. Such a measurement sequence is similarly determined for each of the voltages applied to the components other than the pre-quadrupole mass filter 12. When the measurement is actually performed, the analysis controller 30 operates the power sources 21-26 according to the determined measurement sequences. The power sources 21-26 apply voltages to the ion transport optical systems including the pre-quadrupole mass filter 12.

In the foregoing descriptions, it is assumed that the ions with the same polarity (e.g. positive ions) are sequentially subjected to the SIM measurement. However, in some cases, positive and negative ions are alternately subjected to the measurement. The polarity of the direct-current voltages applied to the respective ion transport optical systems depends on the polarity of the target ion. Therefore, when positive and negative ions are alternately subjected to the measurement, the polarity of the applied voltages is reversed for every dwell time, and therefore, it is useless to reverse the polarity of the voltages in the pause time. Accordingly, the previously described operation of reversing the polarity of the applied voltage in the pause time needs to be performed only when the polarity of the ion to be monitored in the dwell time is unchanged before and after the pause time.

Figure 7:
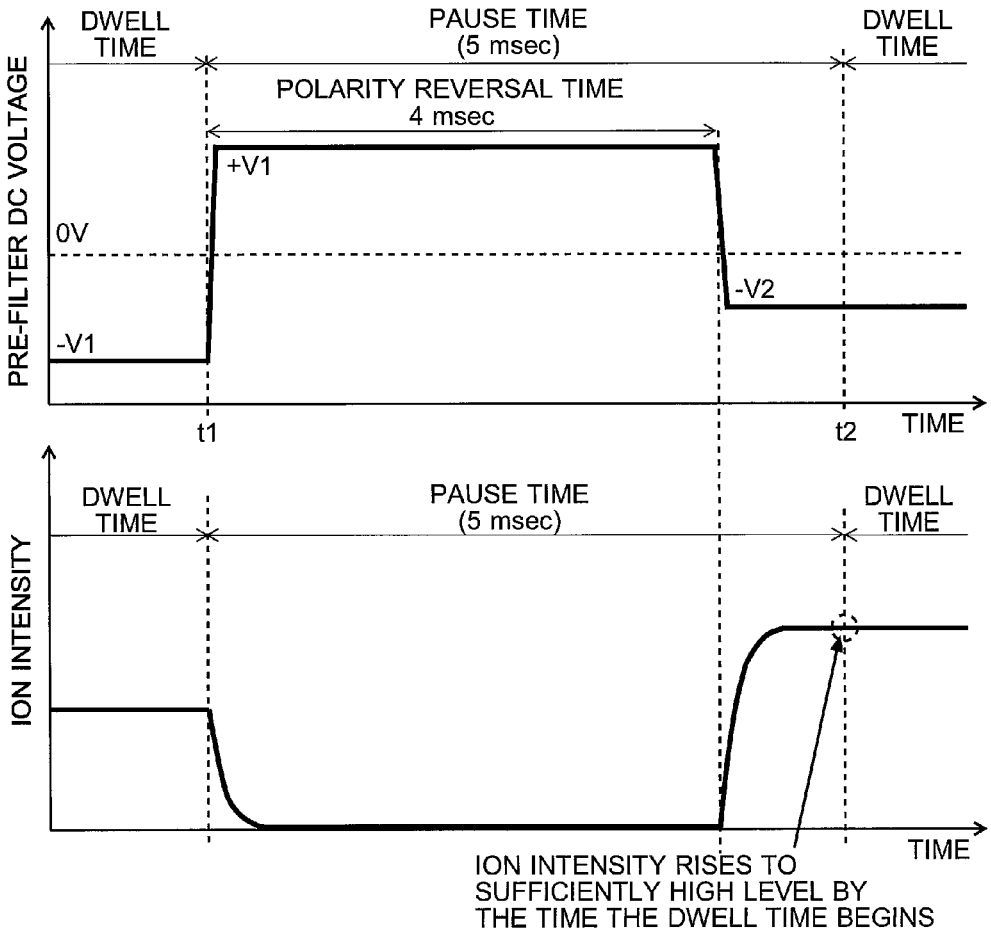
FIG. 7 shows a change of the applied voltage and a change of the ion intensity in the case where the pause time is set at 5 ms and the direct-current voltage polarity reversal time at 4 ms.

FIG. 7 shows a change of the applied voltage and a change of the ion intensity in the case where the pause time is set at a long value of 5 ms and the direct-current voltage polarity reversal time at 4 ms. Such a long pause time allows the direct-current voltage polarity reversal time to be increased, without delaying the rising of the ion intensity, to such an extent that the charges can be dissipated with a greater degree of certainty within the voltage polarity reversal time, so that the charge-up will be more effectively eliminated.

The previously described embodiment is concerned with the case where the polarity of the direct-current voltage applied to the pre-quadruple mass filter 12 is reversed in the pause time. It is evident that the polarity of the direct-current voltages applied to other ion transport optical systems may similarly be reversed in the pause time in order to eliminate or reduce the charge-up of those ion transport optical systems.

It is also possible to simply decrease the direct-current voltage in the pause time to a value (absolute value) smaller than the values (absolute values) of the direct-current voltage used in the dwell times before and after that pause time, without reversing the polarity of the direct-current voltage. In this case, since the polarity of the voltage applied to the ion transport optical system remains opposite to that of the ions, the effect of dispersing the accumulated electric charges cannot be obtained. However, decreasing the voltage produces the effect of impeding the passage of the ions through the system (e.g. the pre-quadrupole mass filter 12) in the pause time, so that the charge-up of the ion transport optical systems on the rear side (i.e. the main quadrupole mass filter 13 and its support structure) can be reduced as in the case of stopping the application of the radio-frequency voltage (which will be described later).

In the case of an ion transport optical system to which a radio-frequency voltage for primarily focusing ions (and in some cases, for dispersing unwanted ions) is applied in addition to the direct-current voltage, the amplitude of the radio-frequency voltage may be temporarily decreased to zero (i.e. to stop the application of the radio-frequency voltage), or to a sufficiently small magnitude at which the ion-focusing effect nearly disappears, in the pause time in order to eliminate or reduce the charge-up of another ion optical transport system placed on the rear side of the ion transport optical system concerned.

Figure 8:
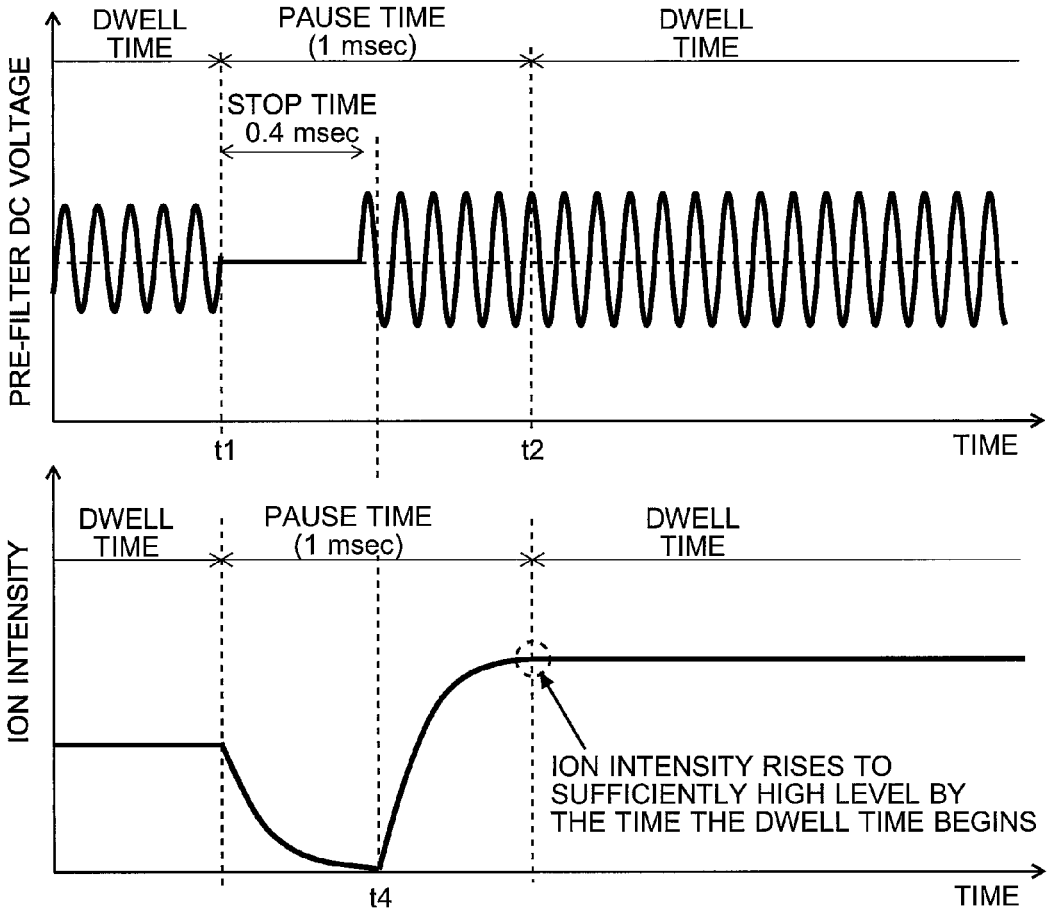
FIG. 8 shows a change of the radio-frequency voltage and a change of the ion intensity in a quadrupole mass spectrometer according to another embodiment of the present invention.

For example, in the quadrupole mass spectrometer shown in FIG. 1, the pre-quadrupole mass filter 12 is normally supplied with not only the direct-current voltage but also the same radio-frequency voltage as the one applied to the main quadrupole mass filter 13 in the subsequent stage. Accordingly, as shown in FIG. 8, the application of the radio-frequency voltage is stopped during the "stop time" which is included in the pause time and which corresponds to the voltage polarity reversal time in the previous embodiment. This causes the ion-focusing effect within the space in the pre-quadrupole mass filter 12 to disappear, and allows the ions to disperse, so that the ions cannot pass through the pre-quadrupole mass filter 12. Additionally, when the radio-frequency quadrupole electric field is created by the pre-quadrupole mass filter 12, the ions are bound by that field and tend to accumulate at a step of the direct-current potential which is formed between the pre-quadrupole mass filter 12 and the main quadrupole mass filter 13. Those ions easily come in contact with the support structure for the main quadrupole mass filter 13 (or other components) and cause a charge-up. In this situation, when the application of the radio-frequency voltage to the pre-quadrupole mass filter 12 is stopped in the previously described way and the binding effect by the electric field is thereby cancelled, the ions at the potential step become easier to move and their density becomes lower, so that the charge-up of the support structure for the main quadrupole mass filter 13 (or other components) is reduced.

Similarly to the previous embodiment, the length of time to stop the application of the radio-frequency voltage or decrease its amplitude to such an extent that the ion-focusing effect virtually disappears should preferably be changed according to the length of the pause time.

In the previous embodiment, the present invention is applied in a normal type of quadrupole mass filter. The present invention can also be applied in a tandem quadrupole mass spectrometer having front and rear quadrupole mass filters with a collision cell in between. In this case, the operation of reversing the polarity of the direct-current voltage applied to the ion transport optical system or stopping the application of the radio-frequency voltage can be performed in the pause time which is assigned for switching the mass-to-charge ratios of the ions to be selected by the front and rear quadrupole mass filters (the precursor ion and product ion) in an MRM measurement (not the SIM measurement). This evidently produces similar effects to those described in the previous embodiment.

Furthermore, it should be noted that any of the previous embodiments is an example of the present invention, and any change, addition or modification appropriately made within the spirit of the present invention in some respects other than those already described will evidently fall within the scope of claims of the present application.

REFERENCE SIGNS LIST

1 . . . Casing
2 . . . Ionization Chamber
3 . . . First Intermediate Vacuum Chamber
4 . . . Second Intermediate Vacuum Chamber
5 . . . Analysis Chamber
6 . . . Electrospray Ionization Probe
7 . . . Heated Capillary
8 . . . Ion Lens
9 . . . Skimmer
10 . . . Multipole Ion Guide
11 . . . Aperture Electrode
12 . . . Pre-Quadrupole Mass Filter
13 . . . Main Quadrupole Mass Filter
14 . . . Ion Detector

21-26 . . . Power Source
30 . . . Analysis Controller
31 . . . Measurement Sequence Determiner
32 . . . Measurement Parameter Storage Section
32*a* . . . Table
35 . . . Data Processor
36 . . . Controller
37 . . . Input Unit
38 . . . Display Unit
C . . . Ion Beam Axis

The invention claimed is:

1. A mass spectrometer having one or more ion transport optical systems for transporting ions by an effect of an electric field between an ion source and an ion detector, the mass spectrometer being capable of performing an SIM or MRM measurement in which an operation of sequentially performing a mass spectrometry on each of a plurality of ions having previously specified mass-to-charge ratios is cyclically performed, and the mass spectrometer comprising:

a) a voltage generator for applying a direct-current voltage corresponding to the mass-to-charge of an ion to be monitored, to at least one of the ion transport optical systems in the SIM or MRM measurement; and b) a controller for controlling the voltage generator so that, in a pause time during which collection of detection data by the ion detector is suspended in conjunction with a switching of the mass-to-charge ratio of the ion to be monitored, if a polarity of the ion to be monitored in an SIM or MRM measurement is unchanged before and after the switching of the mass-to-charge ratio, then the direct-current voltage applied to the at least one ion transport optical system, while being switched from one specific level to another specific level in the pause time, is temporarily changed to either a level at which the direct-current voltage has a polarity different from the polarity of the direct-current voltage at those specific levels, or a level at which the direct-current voltage has the same polarity as the direct-current voltage at those specific levels yet has a smaller absolute value than the direct-current voltage at any of those specific levels.

2. The mass spectrometer according to claim 1, wherein:

the controller controls the voltage generator so that the direct-current voltage applied to the at least one ion transport optical system, while being switched in the pause time, is temporarily changed to a level at which the direct-current voltage has a polarity different from the polarity of the direct-current voltage applied before and after the switching of the direct-current voltage.

3. The mass spectrometer according to claim 2, wherein:

the controller varies a period of time assigned for temporarily applying the direct-current voltage with the different polarity, according to a length of the pause time.

4. The mass spectrometer according to claim 3, wherein:

the at least one ion transport optical system is an ion transport optical system placed immediately before a quadrupole mass filter for separating ions according to the mass-to-charge ratios of the ions.

5. The mass spectrometer according to claim 2, wherein:

the at least one ion transport optical system is an ion transport optical system placed immediately before a quadrupole mass filter for separating ions according to the mass-to-charge ratios of the ions.

6. The mass spectrometer according to claim 1, wherein:

the at least one ion transport optical system is an ion transport optical system placed immediately before a quadrupole mass filter for separating ions according to the mass-to-charge ratios of the ions.

7. A mass spectrometer having one or more ion transport optical systems for transporting ions by an effect of an electric field between an ion source and an ion detector, the mass spectrometer being capable of performing an SIM or MRM measurement in which an operation of sequentially performing a mass spectrometry on each of a plurality of ions having previously specified mass-to-charge ratios is cyclically performed, and the mass spectrometer comprising:

a) a voltage generator for applying a radio-frequency voltage having an amplitude corresponding to the mass-to-charge ratio of an ion to be monitored, to at least one of the ion transport optical systems in the SIM or MRM measurement; and b) a controller for controlling the voltage generator so as to temporarily change an amplitude of the radio-frequency voltage applied to the at least one ion transport optical system, to an amplitude at which an ion-focusing effect of the radio-frequency voltage disappears, while switching the amplitude of the radio-frequency voltage in a pause time during which collection of detection data by the ion detector is suspended in conjunction with a switching of the mass-to-charge ratio of the ion to be monitored in an SIM or MRM measurement.

8. The mass spectrometer according to claim 7, wherein:

the controller varies a period of time assigned for temporarily changing the radio-frequency voltage to the amplitude at which the ion-focusing effect disappears, according to a length of the pause time.

9. The mass spectrometer according to claim 8, wherein:

the at least one ion transport optical system is an ion transport optical system placed immediately before a quadrupole mass filter for separating ions according to the mass-to-charge ratios of the ions.

10. The mass spectrometer according to claim 7, wherein:

the at least one ion transport optical system is an ion transport optical system placed immediately before a quadrupole mass filter for separating ions according to the mass-to-charge ratios of the ions.

* * * * *